US005194140A

United States Patent [19]

Dobrovolskis et al.

[11] Patent Number: 5,194,140

[45] Date of Patent: Mar. 16, 1993

[54] ELECTROPLATING COMPOSITION AND PROCESS

[75] Inventors: Pranas Dobrovolskis; Nina Kashtalyanova; Gytis-Kazimeras Kupetis; Budilovskil Julius, all of Vilnius, U.S.S.R.

[73] Assignee: MacDermid, Incorporated, Waterbury, Conn.

[21] Appl. No.: 800,144

[22] Filed: Nov. 27, 1991

[51] Int. Cl.[5] ..... C25D 3/56; C25D 3/12

[52] U.S. Cl. ..... 205/245; 106/1.16; 106/1.17; 205/269

[58] Field of Search ..... 205/244, 245, 269; 106/1.16, 1.17

[56] References Cited

U.S. PATENT DOCUMENTS

| | | | |
|---|---|---|---|
| 3,538,147 | 11/1970 | Morita et al. | 260/485 |
| 3,869,358 | 3/1975 | Nobel et al. | 204/55 |
| 3,884,774 | 5/1975 | Kessler | 204/55 |
| 3,954,575 | 5/1976 | Yanagida et al. | 204/55 |
| 4,007,098 | 2/1977 | Rosenberg | 204/55 |
| 4,100,040 | 7/1978 | Rosenberg | 204/55 |
| 4,135,992 | 1/1979 | Fikentscher et al. | 204/55 |
| 4,299,671 | 11/1981 | Tremmel et al. | 204/35 |
| 4,325,790 | 4/1982 | Adaniya et al. | 204/27 |
| 4,717,458 | 1/1988 | Martin et al. | 204/44.2 |

FOREIGN PATENT DOCUMENTS

| | | |
|---|---|---|
| 3068779 | 3/1991 | Japan . |
| 1219600 | 3/1986 | U.S.S.R. . |
| 2116588 | 1/1983 | United Kingdom . |
| 2160223 | 1/1983 | United Kingdom . |

*Primary Examiner*—John Niebling
*Assistant Examiner*—Brian M. Bolam
*Attorney, Agent, or Firm*—St. Onge, Steward, Johnston & Reens

[57] ABSTRACT

The invention presented relates to (a) novel complexes of cobalt salts and copolymers of maleic anhydride, ethylenediamine and epichlorohydrin; (b) electroplating compositions for deposit of zinc-cobalt alloys wherein the cobalt is employed in the form of a complex of the above type; and (c) a process for the electrodeposition of bright zinc-cobalt alloys using the latter compositions. Optionally, the electroplating compositions also contain minor amounts of at least one of poly(ethylenediamine); a polycondensate of a di-alkyl diallylammonium chloride and sulfur dioxide; a polycondensate of ethylenediamine, epichlorohydrin and dichloroethane; a polycondensate of piperazine, formaldehyde, epichlorohydrin and thiourea; the reaction product of dimethylaminopropylamine with epichlorohydrin; a polycondensate of tetraethylenepentamine and epichlorohydrin; the reaction product of imidazole with epichlorohydrin; the reaction product of hexamethylenetetramine with epichlorohydrin; a polycondensate of poly(ethylenediamine) and epichloroydrin; or a polycondensates of morpholine, imidazole, and epichlorohydrin.

20 Claims, 1 Drawing Sheet

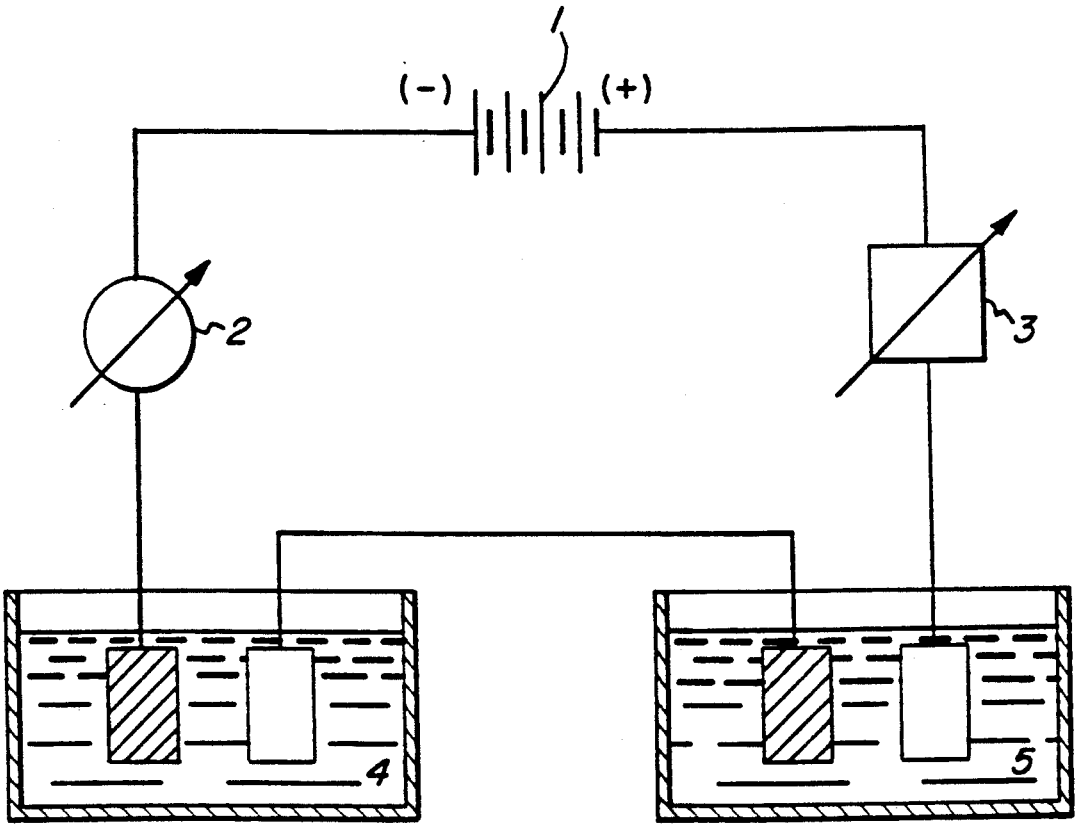
1
(-)
(+)
2
3
4
5

ELECTROPLATING COMPOSITION AND PROCESS

FIELD OF THE INVENTION

This invention relates to novel complexes of cobalt salts and certain copolymers, and to their use in electroplating compositions. More particularly, the invention is concerned with complexes of cobalt salts with copolymers of maleic anhydride, ethylenediamine and epichlorohydrin, with the use of these complexes as the source of cobalt in zinc-cobalt electroplating compositions. Improved coatings of zinc-cobalt alloys are obtained using the latter compositions.

BACKGROUND OF THE INVENTION

The electrodeposition of zinc-cobalt alloys on metallic substrates such as iron, steel, and like metals to provide increased corrosion resistance is finding increasing acceptance in the marketplace. Such alloys not only provide increased corrosion resistance compared to traditional zinc deposits, but have the additional advantage of exhibiting bright, aesthetically pleasing surfaces.

Illustrative of electrolytes for electroplating of zinc-cobalt alloys from acid solution are those described in U.S. Pat. No. 4,325,790 and British Patents 2,116,588A and 2,160,223A. However, the metal concentration in such electrolytes is relatively high, which makes waste water treatment expensive and time-consuming. Further, the content of cobalt in the alloys deposited from these electrolytes is a function of the cathode current density. Shaped parts are, therefore, difficult to coat uniformly using this type of electrolyte.

Electrolytes for plating zinc-cobalt deposits from alkaline media (i.e., pH of 8–9) are also known. See, for example, U.S. Pat. No. 4,717,458, which employs a chelating agent such as sodium glucoheptonate in combination with salts of zinc and cobalt. The high content of chelate and of cobalt salt in the elecrolyte makes expensive and time-consuming the treatment of waste water in an environmentally acceptable manner.

Other electrolytes containing complexing agents are described, for instance, in U.S. Pat. No. 4,299,671 in which the pH of the electrolyte is in the range of 6–9 and complexing agents such as citric, gluconic, glucoheptonic, and tartaric acids are employed. Ligands such as ethylenediamine, diethanolamine, and triethanolamine can also be used in the alkaline electrolyte baths.

The properties of these zinc-cobalt coatings (alloy composition, corrosion resistance) are not as good as those of the coatings deposited from the electrolytes proposed herein. The complexes of the noted ligands with cobalt salts are unstable and they precipitate in the course of electrolysis upon being added into an alkaline electrolyte and after the lapse of time. In addition, treatment of waste liquids from such baths is similarly expensive and time-consuming.

It has now been found that the use of novel cobalt salt complexes in an electrolyte for electrodeposition of zinc-cobalt not only serves to obviate the above problems, but also gives rise to improved efficiency of the electroplating process and improved properties of the cobalt-zinc alloy which is deposited.

SUMMARY OF THE INVENTION

It is an object of the present invention to provide an electroplating bath which produces zinc-cobalt alloys having excellent homogeneity. It is a further object of the invention to provide an alkaline zinc-cobalt plating bath which produces a glossy zinc-cobalt alloy deposit. It is yet another object to provide a plating bath having a low concentration of cobalt, but having high throwing power and efficiency and yielding a highly corrosion resistant zinc-cobalt coating. These objects, and other objects which will become apparent from the description hereafter, are achieved by the compositions and process of the invention.

The invention, in one aspect, comprises novel complexes of (i) a cobalt salt and (ii) a copolymer of maleic anhydride, ethylenediamine and epichlorohydrin, which complexes can be represented by the following formula

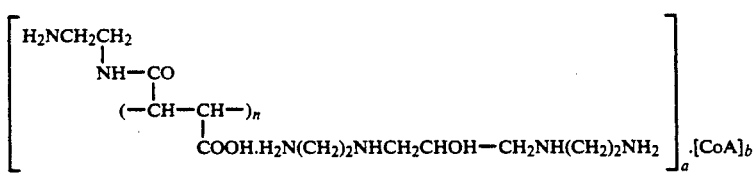

(I)

wherein n has an average value of about 2 to about 20, A represents $SO_4$, $Cl_2$, citrate, tartrate, or acetate, and the ratio of a:b is in the range of about 5:1 to abou. 5:2.

The invention also comprises electrolytes for the electrodeposition of zinc-cobalt alloys on a conductive surface, which electrolytes comprise a soluble source of zinc, a soluble source of cobalt and a brightening agent. The source of cobalt used in the inventive electrolytes is a complex of the formula (I) above. The invention further comprises a process for the electrodeposition of zinc-cobalt alloys using the electrolytes of the invention and the improved zinc-cobalt alloy coatings so produced.

The electrolytes of the invention are characterized by high throwing power, i.e., the ability to deposit uniform coatings in low current density areas, high efficiency, and uniformity of coatings. The zinc-cobalt deposits produced in accordance with the invention possess enhanced corrosion resistance and decorative properties.

DESCRIPTION OF THE DRAWINGS

This invention will be better understood and its advantages will become more apparent from the following detailed description, especially when read in light of the attached drawing, which is a schematic description of a coulometer useful for determining the cathode efficiency of the inventive process.

DETAILED DESCRIPTION OF THE INVENTION

The complexes of formula (I) above are prepared by bringing together (a) a cobaltic salt, CoA where A represents a divalent anion of which sulfate, dichloride, citrate, tartrate, and acetate are typical and (b) a copolymer of maleic anhydride, ethylenediamine and epichlorohydrin.

The copolymer is advantageously prepared by first reacting maleic anhydride with an excess over molar equivalent amount of ethylenediamine. The ethylenediamine is preferably present as an aqueous solution in an amount of about 1.5 to about 4.0 moles per mole of maleic anhydride. The reaction is exothermic and the reaction temperature is controlled conveniently by the addition of the anhydride to the diamine with constant agitation at a rate such that the temperature does not exceed about 110° C.

When the addition is complete the reaction mixture is maintained at a temperature in the range of about 100° C. to about 120° C. for a short period of time, advantageously about one hour. At the end of this period, water is added to the reaction followed dropwise by epichlorohydrin at a rate to maintain the temperature in the range of about 80° C. to 90° C. The amount of epichlorohydrin is preferably within the range of about 0.25 to about 1.0 moles per mole of maleic anhydride employed in the first step of the synthesis.

After the addition is complete, the reaction mixture is agitated for a period of time and the resulting copolymer product is then admixed with the cobalt salt to form the desired complex. An initiator such as sodium, potassium, or ammonium persulfate in aqueous solution, and the like, can be added to the mixture to promote formation of the complex. The reaction temperature in formation of the complex is advantageously in the range of about 60° C. up to about 100° C.

The proportion of cobalt salt employed in preparing the complex is within the range of about 1:5 to about 2:5 moles per mole equivalent of copolymer. The complex so obtained is in the form of an aqueous solution, which, if desired, can be diluted with water prior to employment in the electrolytes of the invention.

Electroplating baths for the electrodeposition of zinc-cobalt alloys generally comprise aqueous solutions containing a soluble source of zinc ions such as zinc chloride, zinc sulfate, zinc fluoborate, zinc acetate and the like, together with a soluble source of cobalt, a soluble electrolyte and a brightening agent. In the case of the alkaline baths of the invention, the zinc is solubilized advantageously in the bath by dissolution of zinc oxide in aqueous sodium hydroxide. The novel complexes of formula (I) are employed as the soluble source of cobalt ions in the electrolyte.

The amount of zinc ion present in the bath is preferably on the order of about 6.0 grams (g.)/liter to about 12.0 g./liter, and, more preferably, is on the order of about 8.0 g./liter to about 10.0 g./liter. The amount of soluble cobalt ion in the form of the above complex is preferably on the order of about 0.5 g./liter to about 2.0 g./liter and, more preferably, from about 1.0 g./liter to about 1.5 g./liter for rack plating and about 0.1 g./liter to about 0.5 g./liter and, more preferably, from about 0.2 g./liter to about 0.3 g./liter for barrel plating. It is to be noted that this cobalt ion concentration is significantly lower than is commonly employed in the electrodeposition of zinc-cobalt alloys.

The electrolyte compositions of the invention also comprise one or more brightening agents. The brightening agents employed can be any of those conventionally employed in the art in alkaline zinc-cobalt plating baths including combinations of two or more brighteners. Illustrative of such agents are aromatic aldehydes such as o-chlorobenzaldehyde, anisaldehyde, thiophene aldehyde, cinnamic aldehyde, vanillin (and the bisulfites of those aldehydes), piperonal, benzylidene acetone, coumarin, betaines and the like. Advantageously, the brightening agent, or a combination of two or more such agents, is present in an amount in the range of about 0.01 g./liter to about 0.1 g./liter.

In a particular embodiment, the electrolyte compositions of the invention can also include minor amounts, on the order of about 0.2 g./liter to about 2.0 g./liter of one or more water-soluble polymers. Illustrative of such polymers are the following:

(a) polyethylene polyamines of the formula —HN-(—$CH_2$—$CH_2$—NH—)$_n$, where n has an average value of about 1 to about 5.

(b) polycondensates of dialkyl diallylammonium halides with sulfur dioxide. These polycondensates are obtained advantageously by reacting a quaternary ammonium halide with sulfur dioxide in the presence of a catalytic amount of a cobalt salt such as cobaltic dichloride and an initiator such as an alkali metal persulfate, especially potassium, ammonium, or sodium persulfate, and the like. A typical process for preparation of these polycondensates is given in detail in Preparation 1 hereinafter.

A representative polycondensate can be represented by the formula:

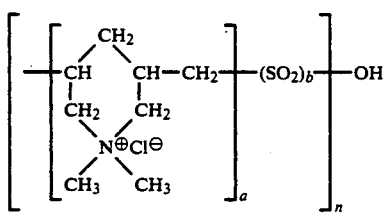

(II)

where the ratio of a to b is about 1:0.91 to about 1:0.97 and n has an average value of about 15 to about 45.

(c) The product of the condensation of ethylenediamine, epichlorohydrin and dichlorethane in a molar ratio in the range of about 1:(0.5–0.95):(0.05–0.5), respectively. The polycondensation is advantageously carried out in accordance with the procedure described in U.S.S.R. Patent 1,219,600. The polycondensates of the above type can be represented by the following formula

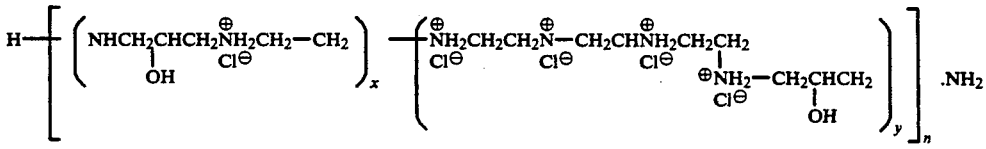

(III)

where x is up to about 380; y is between about 3 and about 45; n is between about 3 and about 420; and the molecular weight can range between about 1000 and about 72,000. A typical preparation of such a polycondensate is given in Preparation 2 hereinafter.

(d) The product of the condensation of piperazine, formaldehyde, epichlorohydrin, and thiourea in a molar ratio in the range of about 1:(0.5–2.0):(0.5–2.0):(0.3–0.5.0), respectively. The polycondensation is advantageously carried out in accordance with the procedure described in U.S.S.R. Patent 751,176. A typical preparation of such a polycondensate is given in Preparation 3 hereinafter.

(e) The product of the reaction of dimethylaminopropylamine with epichlorohydrin in a molar ratio of about 1:1, respectively. The polycondensation is described in U.S. Pat. No. 3,869,358 or U.S. Pat. No. 3,884,774. The polycondensate of the above type can be represented by the following formula

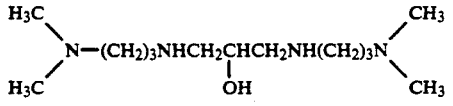

(f) The product of the condensation of tetraethylenepentamine and epichlorohydrin in a molar ratio of about 1:3, respectively. The polycondensation is described in U.S. Pat. No. 4,007,098. The polycondensate of the above type can be represented by the following formula:

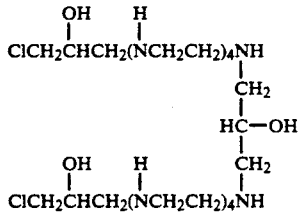

(g) The product of the reaction of imidazole and epichlorohydrin in a molar ratio of about 1:1.7, respectively. The polycondensation is described in U.S. Pat. No. 3,954,575. The polycondensate of the above type can be represented by the following formulae:

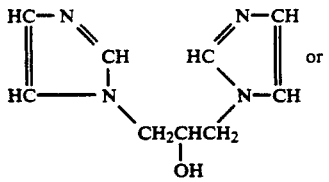

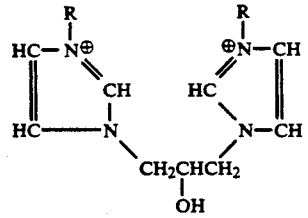

where R is —$CH_2CH(OH)CH_2OH$ and n is 0 or 1.

(h) The product of the condensation of ethylenediamine and epichlorohydrin in a molar ratio of about 1:2, respectively. The polycondensation is described in U.S. Pat. Nos. 4,007,098 and 4,100,040. The polycondensate of the above type can be represented by the following formula:

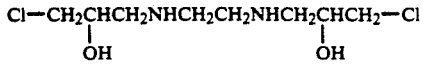

(i) The product of the reaction of hexamethylenetetramine and epichlorohydrin in a molar ratio of 1:2.7, respectively. The polycondensate of the above type can be represented by the following formulae:

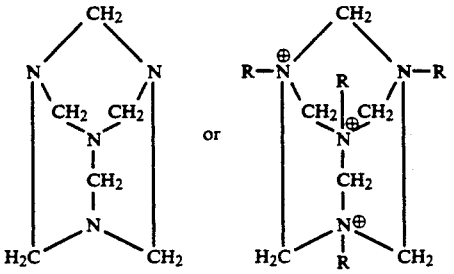

where R is —$CH_2CH(OH)CH_2OH$.

(j) The product of the condensation of polyethyleneimine and epichlorohydrin in a molar ratio of about 1:0.7, respectively. The polycondensation is described in U.S. Pat. No. 4,135,992. The polycondensate of the above type can be represented by the following formula:

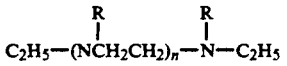

where R is —H or —$CH_2CH(OH)CH_2OH$ and n is 20.

(k) The reaction product of morpholine, imidazole and epichlorohydrin. The polycondensation is described in U.S. Pat. No. 3,538,147.

When employed in electrolytic baths in accordance with the invention, the above polymers (a)–(k) are generally employed in a range of about 0.5 g./liter to about 3.0 g./liter and preferably in the range of about 1.0 g./liter to about 2.0 g./liter.

The electrolytic baths of the invention can also contain any other additives, such as surfactants and the like, commonly employed in such baths.

The electroplating baths of the invention are employed to apply coatings of zinc-cobalt alloys to workpieces using procedures well known in the art. Illustratively, the workpiece to be coated is made the cathode in a bath having a composition in accordance with the invention as described above, and an anode of zinc or unsoluble simple steel or like material is provided. A voltage is applied across the anode and cathode and electroplating is continued until the desired thickness of zinc-cobalt has been deposited on the workpiece. Generally speaking, the bath is operated at a temperature within the range of about 15° C. to about 30° C.

It has been surprisingly found that, although the concentration of cobalt ion in the baths of the invention is significantly below the level normally employed hitherto, the properties of the alloys deposited in accordance with the invention and the efficiency of the electrodeposition process are markedly improved. Thus, the zinc-cobalt alloy coatings which are applied by the inventive electrocoating possess a pleasing glossy appearance and are characterized by homogeneity in terms of the ratio of cobalt to zinc throughout the coating. Furthermore, the electroplating baths and process of the invention are characterized by high efficiency and markedly improved throwing power, by which is meant the ability to deposit uniform coatings in places of low current density, e.g., in workpieces having nonplanar surfaces such as threaded areas of bolts, inner rims of washers and the like. The low cobalt concentration present in the electrolytic baths of the invention greatly simplifies the treatment of waste liquids from the baths, as will be readily appreciated by one skilled in the art.

The following preparations and examples serve to illustrate the compositions and process of the invention, including the best mode presently known to the inventors, but are not to be construed as limited.

PREPARATION 1

A condensation product of dimethyl diallylammonium chloride and sulfur dioxide having the formula II above is prepared as follows.

To a solution of 16.16 g. (0.1 mole) of dimethyl-diallylammonium chloride in a mixture of 30 ml. of water and 2.5 ml. of acetone is added 0.0238 g. (0.0001 mole) of cobaltic dichloride hexahydrate. The resulting solution is stirred and maintained at 20° C. and a stream of sulfur dioxide is passed therethrough until a total of 7.6 g. (0.12 mole) is absorbed. The temperature of the solution is then allowed to rise to about 30° C. and a solution of 0.2 g. of sodium persulfate in 0.9 ml. of water is added with stirring. An exothermic reaction ensues and the temperature of the solution rises to about 75° C. When the temperature of the solution begins to drop, a further addition of 0.3 g. of sodium persulfate dissolved in 1.3 ml. of water is made. When the exotherm has subsided, the resulting mixture is heated at 85°-110° C. for five hours with stirring. There is thus obtained 55 g. of an aqueous solution containing the desired polycondensate.

PREPARATION 2

A condensation product of ethylenediamine, epichlorohydrin, and dichloroethane having the formula III above is prepared as follows.

A 50/50 aqueous solution of ethylenediamine (240 g.; 2.0 moles) is heated to 70° C. Added thereto is 81 g. (68.5 ml. or 0.875 mole) of epichlorohydrin and 24.75 g. (19.7 ml. or 0.25 mole) of dichloroethane drop by drop under agitation at the rate to maintain the temperature of the reaction mass between about 70° C. and 85° C. The temperature of the reaction mass is brought to 110°-120° C. and maintained at that temperature for 30 minutes. The reaction mass is then cooled to room temperature (about 20° C.) and 83 ml. of water is added. The clear, yellow solution of the product of copolycondensation is obtained, corresponding to a molar ratio of ethylenediamine, epichlorohydrin and dichloroethane of 1:0.87:0.125.

PREPARATION 3

A condensation product of piperazine, formaldehyde, epichlorohydrin, and thiourea is prepared as follows.

To an aqueous solution of 1 mole of piperazine is added 1 mole of a 37% solution of formaldehyde under agitation, and 1 mole of epichlorohydrin is slowly added. As the reaction with epichlorohydrin is exothermic, it is added at a rate such that the temperature does not exceed 80° C. An aqueous solution of approximately 10 g. of thiourea is then added. The temperature of the reaction mixture is allowed to increase to boiling and the mixture is maintained at that temperature for one hour under agitation. The slightly yellow clear solution is obtained. The quantity of reagents is selected in order to get a solution of 10 percentage concentration, based on a dry substance.

EXAMPLE 1

A cobalt complex having the formula (I) above is prepared in the following manner.

To 132 ml. of an aqueous solution containing 70 percent w/v of ethylenediamine (1.5 mole) at 70° C. is added slowly, with vigorous stirring, a total of 58.83 g. (0.6 mole) of maleic anhydride at a rate such that the temperature of the mixture does not exceed 110° C. When the addition is complete, the resulting mixture is maintained at 100°-120° C. with stirring for a further one hour. At the end of this time, the temperature is allowed to fall below 95° C., whereupon 150 ml. of water is added followed dropwise by a total of 27.75 g. (0.3 mole) of epichlorohydrin.

When the addition is complete, the reaction mixture is stirred for a further two hours at 80°-95° C. and then cooled to 40°-50° C. while adding 86.76 g. (0.33 mole) of cobaltic sulfate hexahydrate. To the resulting mixture is added, with vigorous agitation at 40°-50° C., a solution of 2.4 g. of sodium persulfate in 10.8 ml. of water. An exothermic reaction ensues. When the temperature of the mixture begins to fall again, a further portion of 3.6 g. of sodium persulfate in 15.6 ml. of water is made. The resulting mixture is then heated to boiling under reflux for five hours with stirring. Finally, the solution is cooled to room temperature (about 20° C.) and diluted with water to a volume of 535 ml.

There is thus obtained a 33 percent w/v solution of a complex of cobaltic sulfate and a copolymer of ethylenediamine, maleic anhydride, and epichlorohydrin. The cobalt content of the solution is 3.4 percent by weight.

The above procedure is repeated exactly as described but replacing the cobaltic sulfate hexahydrate with 73.43 g. (0.31 mole) of cobaltic chloride.

EXAMPLES 2-14

A series of aqueous electrodeposition baths is prepared by dissolving the components set forth in Table I below in water, all parts being expressed as parts by weight per 1000 parts of solution. The zinc oxide is solubilized in each case by dissolution in the sodium hydroxide.

TABLE I

| | Examples | | | | | | | | | | | | |
|---|---|---|---|---|---|---|---|---|---|---|---|---|---|
| Component | 2 | 3 | 4 | 5 | 6 | 7 | 8 | 9 | 10 | 11 | 12 | 13 | 14 |
| Zinc Oxide | 8 | 10 | 12 | 10 | 10 | 10 | 10 | 10 | 10 | 10 | 10 | 10 | 10 |
| Sodium Hydroxide | 90 | 100 | 110 | 100 | 100 | 100 | 100 | 100 | 100 | 100 | 100 | 100 | 100 |
| Cobalt complex of Ex. 1 | 0.5 | 1 | 1 | 1 | 1 | 1 | 1 | 1 | 1 | 1 | 1 | 1 | 1 |

TABLE I-continued

| Component | Examples 2 | 3 | 4 | 5 | 6 | 7 | 8 | 9 | 10 | 11 | 12 | 13 | 14 |
|---|---|---|---|---|---|---|---|---|---|---|---|---|---|
| Product of Prepn. 1 | 0.5 | 2 | 3 | — | — | — | — | — | — | — | — | — | — |
| Polyethylenepolyamine | — | — | — | 2 | — | — | — | — | — | — | — | — | — |
| Product of Prepn. 2 | — | — | — | — | 2 | — | — | — | — | — | — | — | — |
| Product of Prepn. 3 | — | — | — | — | — | 2 | — | — | — | — | — | — | — |
| Product of Paragraph (e) | — | — | — | — | — | — | 2.5 | — | — | — | — | — | — |
| Product of Paragraph (f) | — | — | — | — | — | — | — | 3 | — | — | — | — | — |
| Product of Paragraph (g) | — | — | — | — | — | — | — | — | 2.5 | — | — | — | — |
| Product of Paragraph (h) | — | — | — | — | — | — | — | — | — | 2 | — | — | — |
| Product of Paragraph (i) | — | — | — | — | — | — | — | — | — | — | 2.5 | — | — |
| Product of Paragraph (j) | — | — | — | — | — | — | — | — | — | — | — | 2 | — |
| Product of Paragraph (k) | — | — | — | — | — | — | — | — | — | — | — | — | 3 |
| Benzil nicotinic acid* | 0.05 | 0.02 | 0.01 | — | 0.02 | — | 0.02 | — | — | 0.02 | — | — | — |
| Allylnicotinic acid* | — | — | — | — | — | — | — | 0.02 | 0.02 | — | 0.02 | 0.02 | — |
| Allylic aldehyde bisulfite* | — | — | — | 0.02 | — | 0.02 | — | — | — | — | — | — | 0.02 |
| Water to make | 1000 | 1000 | 1000 | 1000 | 1000 | 1000 | 1000 | 1000 | 1000 | 1000 | 1000 | 1000 | 1000 |

*present as brightening agents

Each of the baths is employed to coat a steel plate with a zinc-cobalt alloy. The conditions employed are identical for all baths. The substrate to be coated is employed as cathode with a zinc anode in a 267 ml. Hull cell using current power of 1 for barrel plating and 2A for rack plating for a period of ten minutes. The efficiency of each bath is determined using a coulometric method (described below) and the throwing power is determined using a standard Haring-Blum cell. The cobalt content of the zinc-cobalt alloy coating is determined by atomic absorption spectral analysis. The results are tabulated in Table II below.

THE COULOMETRIC METHOD

This procedure can be used to determine the cathode efficiency of the inventive process. The cathode is weighed before and after electrolysis. From the weight difference, the amount of substance plated is determined in the system and coulometer. From the Cu weight deposited in the coulometer on the cathode, the amount of the electricity gone through the system is determined and metal efficiency is calculated as follows:

$$Q = \frac{{}^{m}\text{Cu (pr)}}{\text{0.18 (grams of Cu deposited in 1 ampere-hour at 100\% efficiency)}}$$

where Q is ampere hours and ${}^{m}$Cu is the mass of copper deposited.

$$^{m}\text{Zn-Co (theor.)} = 1.22 \text{ (grams of Zn-Co deposited in 1 ampere—hour at 100\% efficiency)} = Q$$

$$\text{\% cathode efficiency} = \frac{^{m}\text{Zn—Co (pr.)}}{^{m}\text{Zn—Co (theor.)}} \times 100$$

where ${}^{m}$Zn-Co is the mass of zinc-cobalt alloy deposited.

A schematic illustration of a coulometer is illustrated in the drawing, where the current source (rectifier) is indicated at 1; a milliampmeter indicated at 2; resistance indicated at 3; copper coulometer, solution of copper sulfate indicated at 4, and zinc-cobalt electrolytic test solution indicated at 5. In addition, the cathodes in the coulometer are indicated as cross hatched boxes.

TABLE II

| | Examples 2 | 3 | 4 | 5 | 6 | 7 | 8 | 9 | 10 | 11 | 12 | 13 | 14 |
|---|---|---|---|---|---|---|---|---|---|---|---|---|---|
| Current density range for bright deposit: A/dm$^2$ | 1-10 | 0.01-10 | 1-10 | 1-9 | 0.5-9 | 1-10 | 1-10 | 1-10 | 0.5-10 | 0.6-10 | 1-10 | 1-10 | 1-10 |
| Efficiency at 1 A/dm$^2$, % | 64 | 72 | 68 | 70 | 67 | 64 | 60 | 70 | 70 | 68 | 64 | 69 | 71 |
| Throwing power in 1-10 A/dm$^2$ range, % | 50-70 | 60-80 | 64-84 | 60-80 | 64-80 | 60-80 | 64-78 | 64-80 | 60-78 | 60-76 | 60-80 | 60-74 | 64-82 |
| Cobalt content of deposit at | | | | | | | | | | | | | |
| 1 A/Dm$^2$, % | 0.6 | 0.8 | 0.9 | 0.7 | 0.8 | 0.6 | 0.7 | 0.8 | 0.7 | 0.6 | 0.8 | 0.9 | 0.8 |
| 2 | 0.5 | 0.8 | 1.0 | 0.8 | 0.6 | 0.7 | 0.6 | 0.7 | 0.9 | 0.7 | 0.8 | 0.9 | 0.7 |
| 6 | 0.6 | 0.8 | 0.9 | 0.6 | 0.6 | 0.6 | 0.7 | 0.6 | 0.9 | 0.8 | 0.9 | 0.7 | 0.8 |
| 10 | 0.6 | 0.8 | 0.9 | 0.8 | 0.7 | 0.6 | 0.7 | 0.6 | 0.8 | 0.8 | 0.8 | 0.8 | 0.7 |
| A hours/liter before adjustment of Co content of bath required A = amps | 4 | 6 | 5 | 4 | 4 | 4 | 4.5 | 4 | 5 | 5.5 | 4.5 | 4 | 4 |

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

What is claimed is:

1. A composition for use as the cobalt source in an electroplating process, comprising a complex of a cobalt salt with a copolymer of maleic anhydride, ethylenediamine and epichlorohydrin.

2. The composition of claim 1, wherein said copolymer is prepared by the condensation of maleic anhydride and an excess of ethylenediamine followed by the condensation of the reaction product with epichlorohydrin.

3. The composition of claim 1, wherein said cobalt salt is cobalt sulfate.

4. The composition of claim 1, wherein said cobalt salt is cobalt chloride.

5. The composition of claim 2, wherein said complex has the formula

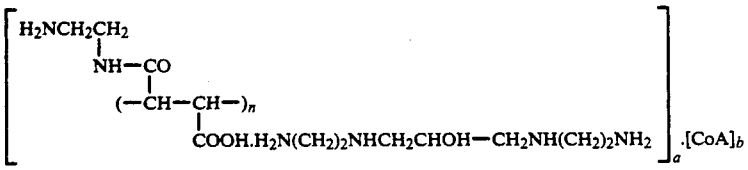

where n has an average value of about 2 to about 20, A represent $Cl_2$, $SO_4$, citrate, tartrate, acetate, and the ratio of a:b is about 5:1 to about 5:2.

6. A composition for use as the cobalt source in an electroplating process, comprising a complex having the formula

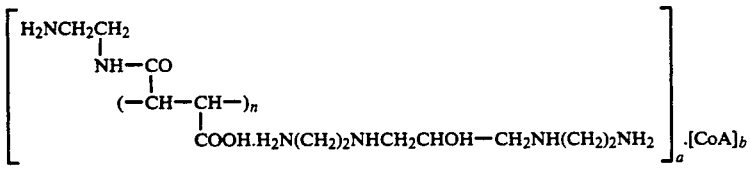

where n has an average value of about 2 to 20, A represents $Cl_2$, $SO_4$, citrate, tartrate or acetate, and the ratio of a:b is about 5:1 to about 5:2.

7. A composition for the electrodeposition of a zinc-cobalt alloy on a conductive surface, said composition comprising a soluble source of zinc, a soluble source of cobalt, a soluble electrolyte, and a brightening agent, wherein said soluble source of cobalt is a complex of a cobalt salt with a copolymer of maleic anhydride, ethylenediamine, and epichlorohydrin.

8. The composition of claim 7, wherein said copolymer is prepared by the condensation reaction of maleic anhydride and an excess of ethylenediamine followed by the condensation of the reaction product with epichlorohydrin.

9. The composition of claim 7, wherein said cobalt salt is cobalt sulfate.

10. The composition of claim 7, wherein said cobalt salt is cobalt chloride.

11. The composition of claim 8, wherein said complex has the formula:

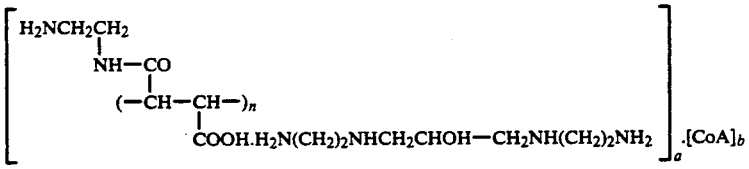

wherein n has an average value of about 2 to about 20, A represents $Cl_2$, $SO_4$, or citrate, tartrate, acetate, and the ratio of a:b is about 5:1 to about 5:2.

12. The composition of claim 7, which further comprises up to about 2 grams per liter of one or more of the following:

(a) a polycondensation product of approximately equimolar amounts of dimethydiallylammonium chloride and sulfur dioxide having the formula:

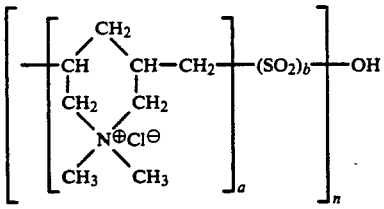

where the ratio of a to b is about 1:0.91 to about 1:0.97 and n has an average value of 15 to 45;

(b) polyethylenediamine;

(c) a polycondensation product of ethylenediamine, epichlorohydrin, and dichloroethane having the formula:

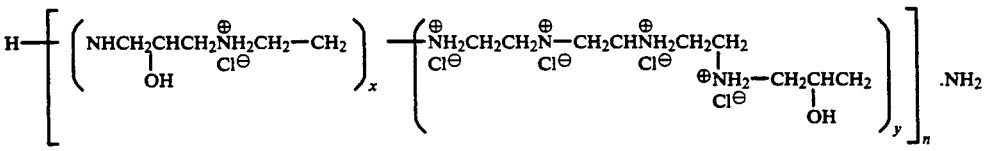

wherein x has a value up to about 380, y has a value from about 3 to about 45, and n has a value from about 3 to about 420;

(d) a polycondensation product of piperazine, formaldehyde, epichlorohydrin, and thiourea in a molar ratio of about 1:(0.5–2):(0.5–2):(0.3–0.5);

(e) a polycondensation product of dimethylaminopropylamine and epichlorohydrin in a molar ratio of about 1:1 having the formula:

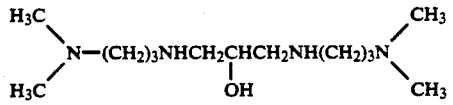

(f) a polycondensation product of tetraethylenepentamine and epichlorohydrin in a molar ratio of 1:3 having the formula:

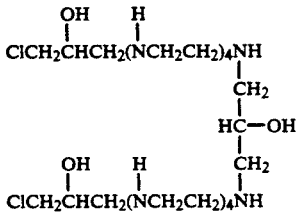

(g) a polycondensation product of imidazole and epichlorohydrin in a molar ratio of about 1:1.6 having the formula:

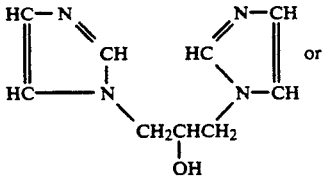

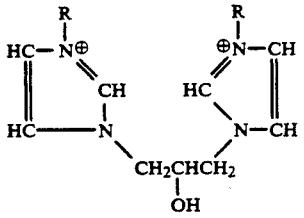

wherein R is —$CH_2CH(OH)CH_2OH$;

(h) a polycondensation product of ethylenediamine and epichlorohydrin in a molar ration of 1:2 having the formula:

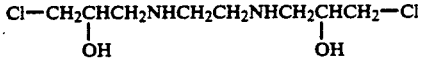

(i) a polycondensation product of hexamethylenetetraamine and epichlorohydrin in a molar ration of about 1:2.7 having the formula:

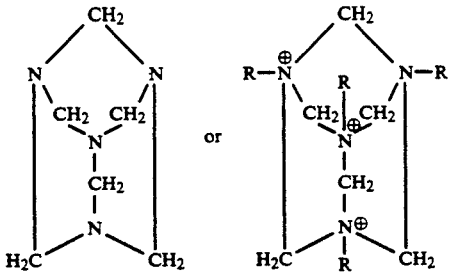

where R is —$CH_2CH(OH)CH_2OH$;

(j) a polycondensation product of polyethyleneimine and epichlorohydrin in a molar ration of about 1:0.7 having the formula:

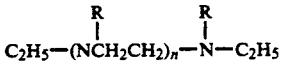

(k) a polycondensation product of morpholine, imidazole and epichlorohydrin.

13. The composition of claim 7, wherein said brightening agent is a betaine.

14. A process for producing a zinc-cobalt electrodeposit on a conductive surface, which comprises:

a. immersing an anode and a substrate containing a conductive surface in a bath comprising a soluble source of zinc, a soluble source of cobalt, a soluble electrolyte, and a brightening agent, wherein said soluble source of cobalt is a complex of a cobalt salt with a copolymer of maleic anhydride, ethylenediamine, and epichlorohydrin; and b. applying a voltage across said anode and said substrate for a period of time sufficient to deposit a zinc-cobalt alloy on said substrate.

15. The process of claim 14, wherein said copolymer is prepared by the condensation reaction of maleic anhydride and an excess of ethylenediamine followed by the condensation of the reaction product with epichlorohydrin.

16. The process of claim 14, wherein said cobalt salt is cobalt sulfate.

17. The process of claim 14, wherein said cobalt salt is cobalt chloride.

18. The process of claim 15, wherein said complex has the formula:

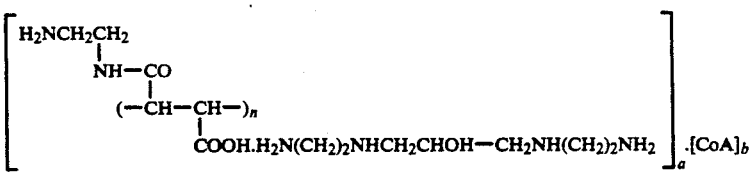

wherein n has an average value of about 2 to about 20, A represents $Cl_2$, $SO_4$, or citrate, tartrate, acetate, and the ratio of a:b is about 5:1 to about 5:2.

19. The process of claim 14 wherein said bath of step (a) further comprises up to about 2 grams per liter of one or more of the following:

(a) a polycondensation product of approximately equimolar amounts of dimethydiallylammonium chloride and sulfur dioxide having the formula:

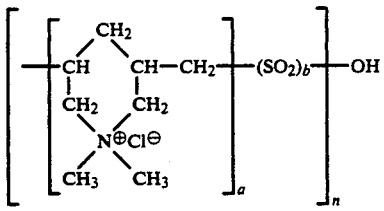

where the ratio of a to be is about 1:0.91 to about 1:0.97 and n has an average value of 15 to 45;

(b) polyethylenediamine;

(c) a polycondensation product of ethylenediamine, epichlorohydrin, and dichloroethane having the formula:

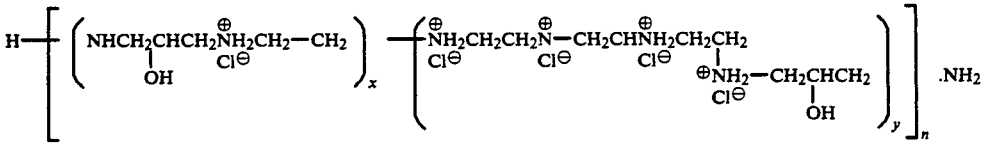

wherein x has a value up to about 380y has a value from about 3 to about 45, and n has a value from about 3 to about 420;

(d) a polycondensation product of piperazine, formaldehyde, epichlorohydrin, and thiourea in a molar ratio of about 1:(0.5–2):(0.5–2):(0.3–0.5);

(e) a polycondensation product of dimethylaminopropylamine and epichlorohydrin in a molar ration of about 1:1 having the formula:

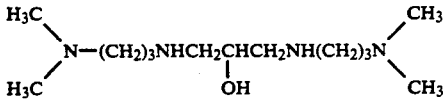

(f) a polycondensation product of tetraethylenepentamine and epichlorohydrin in a molar ration of 1:3 having the formula:

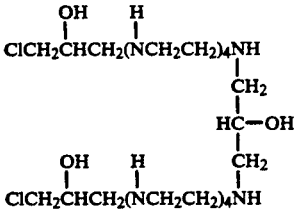

(g) a polycondensation product of imidazole and epichlorohydrin in a molar ratio of about 1:1.6 having the formula:

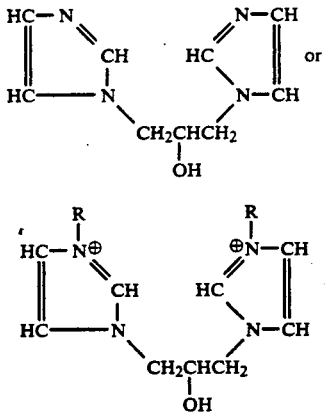

wherein R is —$CH_2CH(OH)CH_2OH$;

(h) a polycondensation product of ethylenediamine and epichlorohydrin in a molar ratio of 1:2 having the formula:

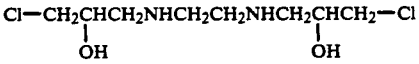

(i) a polycondensation product of hexamethylenetetraamine and epichlorohydrin in a molar ratio of about 1:2.7 having the formula:

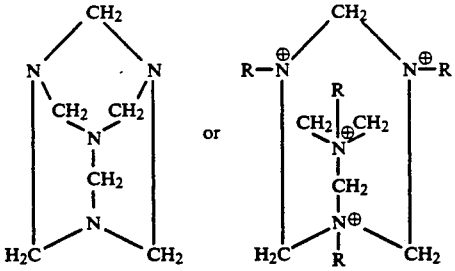

where R is —$CH_2CH(OH)CH_2OH$;

(j) a polycondensation product of polyethyleneimine and epichlorohydrin in a molar ratio of about 1:0.7 having the formula:

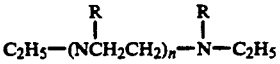

(k) a polycondensation product of morpholine, imidazole and epichlorohydrin.

20. The process of claim 14, wherein said brightening agent is betaine.

* * * * *